US008651478B2

(12) United States Patent
Kameyama et al.

(10) Patent No.: US 8,651,478 B2
(45) Date of Patent: Feb. 18, 2014

(54) SHEET CONVEYING DEVICE AND RECORDING APPARATUS

(75) Inventors: Fumie Kameyama, Inagi (JP); Hiroyuki Saito, Yokohama (JP); Nobuhiro Toki, Kawasaki (JP); Kenji Shigeno, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 269 days.

(21) Appl. No.: 12/910,643

(22) Filed: Oct. 22, 2010

(65) Prior Publication Data

US 2011/0121505 A1 May 26, 2011

(30) Foreign Application Priority Data

Nov. 26, 2009 (JP) ..... 2009-269193

(51) Int. Cl.
*B65H 29/00* (2006.01)

(52) U.S. Cl.
USPC ..... 271/186; 271/258.01; 271/225; 271/184

(58) Field of Classification Search
USPC ..... 271/258.01, 265.01, 265.02, 258.02, 271/65, 186, 225, 184, 185, 3.15, 3.17, 271/4.02, 4.03, 902
See application file for complete search history.

(56) References Cited

U.S. PATENT DOCUMENTS 3,946,921 A * 3/1976 Noguchi ..... 226/43

FOREIGN PATENT DOCUMENTS

GB 2101042 * 1/1983
JP 2007-106040 A 4/2007

* cited by examiner

*Primary Examiner* — Thomas Morrison
(74) *Attorney, Agent, or Firm* — Canon USA Inc IP Division

(57) ABSTRACT

A sheet conveying device includes a first conveying unit configured to convey a sheet in a conveying direction; a conveying path configured to guide the sheet to the first conveying unit, the sheet having been conveyed by the first conveying unit in a direction opposite to the conveying direction; a second conveying unit configured to convey the sheet in the conveying path; a rotation direction detecting unit configured to detect a rotation direction of the second conveying unit; and a control unit configured to perform control, at startup, to drive the first conveying unit in a direction that causes the sheet to be conveyed in the conveying direction, and if the rotation direction detecting unit detects rotation of the second conveying unit, to drive the second conveying unit in the rotation direction that is detected by the rotation direction detecting unit.

17 Claims, 13 Drawing Sheets

SHEET CONVEYING DEVICE AND RECORDING APPARATUS

BACKGROUND OF THE INVENTION

1. Field of the Invention

The present invention relates to a sheet conveying device that conveys a sheet-like recording medium, and to a recording apparatus including the sheet conveying device, such as a copier, a printer, or a facsimile.

2. Description of the Related Art

Japanese Patent Laid-Open No. 2007-106040 describes a recording apparatus that performs a sheet ejection process if a sensor detects a recording sheet when the recording apparatus is powered on. The recording apparatus does not perform the sheet ejection process if the sensor does not detect a recording sheet and the previous recording ended normally. If the previous recording did not end normally, the recording apparatus drives a conveying device by a predetermined amount, and performs the sheet ejection process if the sensor detects a recording sheet and does not perform the sheet ejection process if the sensor does not detect a recording sheet.

It is assumed in Japanese Patent Laid-Open No. 2007-106040 that the recording sheet is ejected in one direction. Therefore, in the case where the recording sheet may be ejected in a plurality of directions, the technology described in Japanese Patent Laid-Open No. 2007-106040 cannot determine the direction in which the recording sheet is to be ejected.

SUMMARY OF THE INVENTION

The present invention provides a recording apparatus that can eject a recording sheet, which has been left therein, along an appropriate route.

According to an aspect of the present invention, a sheet conveying device includes a first conveying unit configured to convey a sheet in a conveying direction; a conveying path configured to guide the sheet to the first conveying unit, the sheet having been conveyed by the first conveying unit in a direction opposite to the conveying direction; a second conveying unit configured to convey the sheet in the conveying path; a rotation direction detecting unit configured to detect a rotation direction of the second conveying unit; and a control unit configured to perform control, at startup, to drive the first conveying unit in a direction that causes the sheet to be conveyed in the conveying direction, and if the rotation direction detecting unit detects rotation of the second conveying unit, to drive the second conveying unit in the rotation direction that is detected by the rotation direction detecting unit.

The aspect of the present invention provides a recording apparatus that ejects a recording sheet, which has been left therein, along an appropriate route.

Further features of the present invention will become apparent from the following description of exemplary embodiments with reference to the attached drawings.

DESCRIPTION OF THE EMBODIMENTS

Figure 1:
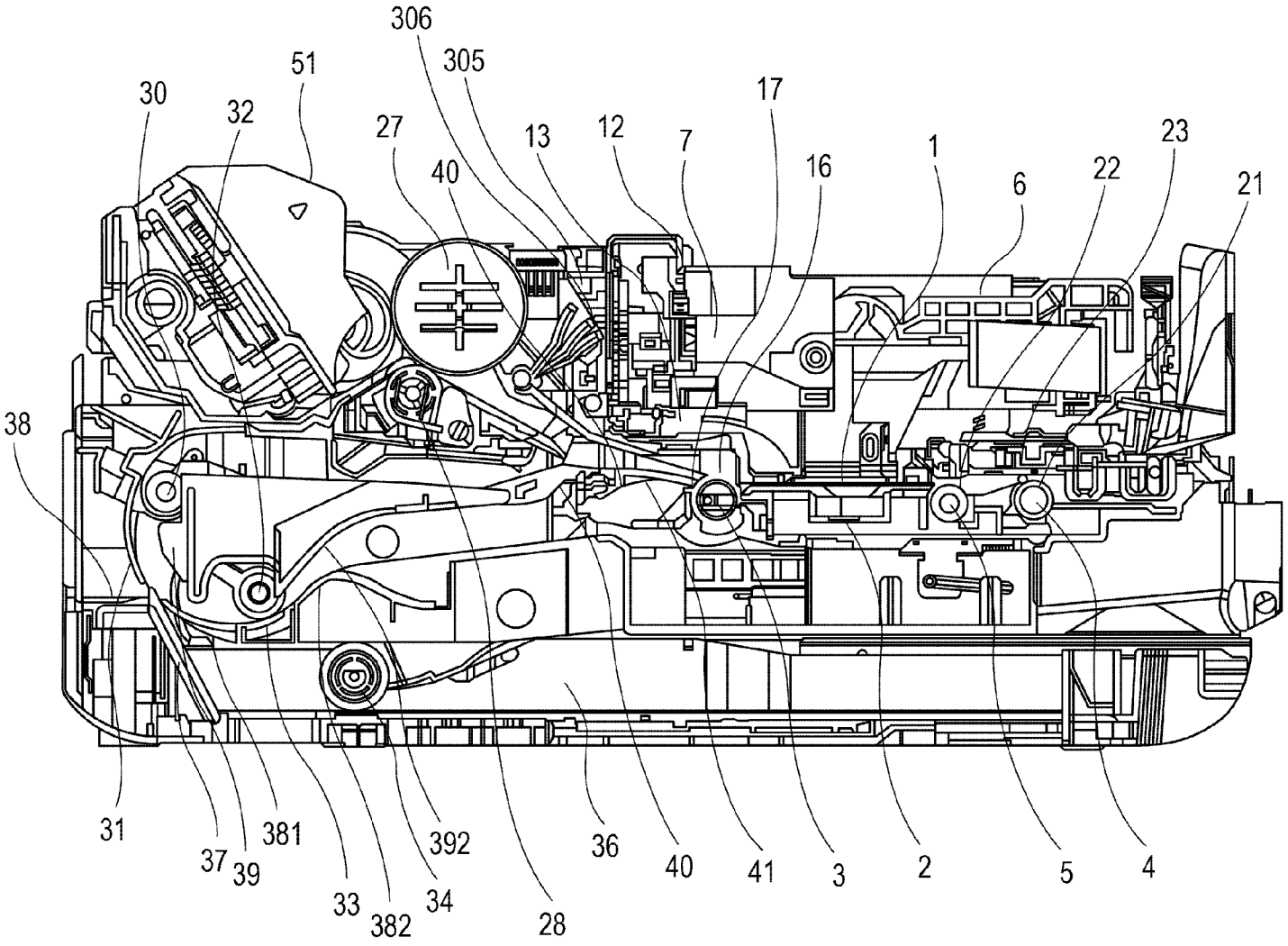
FIG. 1 is a sectional view of a body of an embodiment of the present invention.
Figure 2:
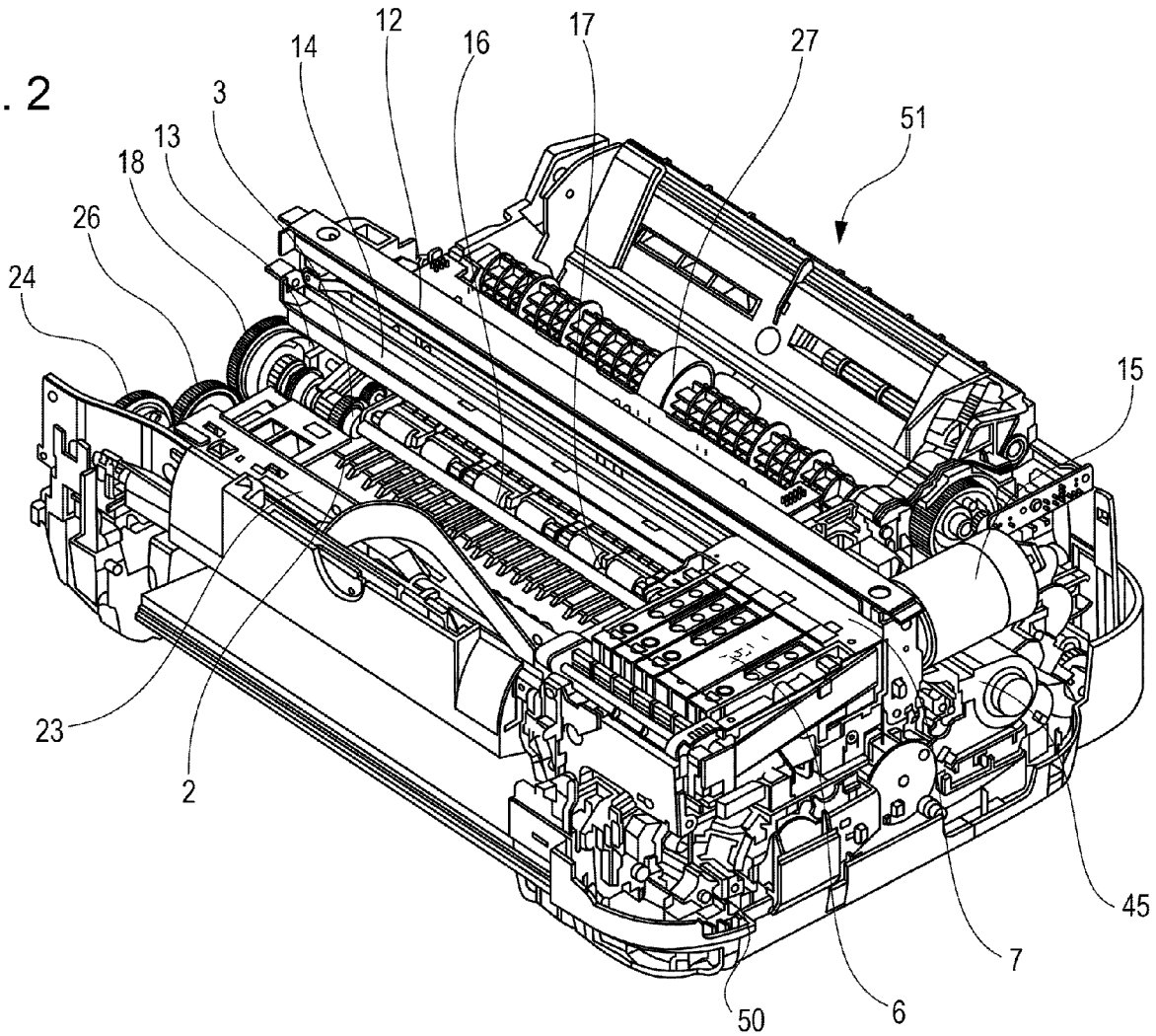
FIG. 2 is a perspective view of the body of the embodiment.

Hereinafter, an embodiment of the present invention will be described with reference to the drawings.

Referring to FIGS. 1 to 7, the mechanism of the recording apparatus will be described. First, the structure of a carriage unit of a printing section, on which a recording head 1 is mounted, will be described. A carriage 7 reciprocates in directions substantially perpendicular to a conveying direction of a recording sheet and performs printing on the recording sheet. The recording head 1 and an ink tank 6 are mounted on the carriage 7. The ink tank 6 is positioned relative to the recording head 1, and the recording head 1 is positioned relative to the carriage 7. The upper part of the carriage 7 is slidably guided by a carriage chassis 12 and positioned relative to the carriage chassis 12. The lower side of the carriage 7 is slidably guided by a carriage rail 13, which is fixed to the carriage chassis 12, and positioned relative to the carriage rail 13.

The carriage 7 moves in directions substantially perpendicular to the conveying direction of a recording sheet along the carriage chassis 12 and the carriage rail 13. The carriage 7 is connected to a timing belt 14, and the carriage 7 moves when the timing belt 14 is driven by a carriage motor 15 that is attached to the carriage chassis 12.

Next, the structures of a sheet feeder and a sheet ejecting section will be described. Recording sheets are stacked on a sheet feeder unit 51. The recording sheets are separated at a nip between a feed roller 27 and a separation roller 28, and conveyed one by one to a conveying roller 3. A pinch roller 16 is pressed against the conveying roller 3 by a spring member (not shown), whereby the pinch roller 16 is rotated. The conveying roller 3 has the largest conveying force among the rollers that convey the recording sheet, and determines the conveyance precision of the recording apparatus. The conveying roller 3 corresponds to a first conveying unit.

The pinch roller 16 is held by a pinch roller holder 17. The recording sheet is fed by the feed roller 27, guided by the pinch roller holder 17, a sheet guide 40, and a sheet guiding portion of a sheet guide flapper 41 to a nip between the conveying roller 3 and the pinch roller 16.

The recording sheet is conveyed further by the conveying roller 3 in a predetermined conveying direction. In the printing section, the recording sheet is supported on a platen 2, which adjusts the position of the recording sheet, and conveyed to a second eject roller 5 and a first eject roller 4. A second pinch roller (spur roller) 22 is pressed against the second eject roller 5. The second pinch roller 22 provides a conveying force to the second eject roller 5, and is rotated by the second eject roller 5. Likewise, a first pinch roller 21 is pressed against the first eject roller 4. The first pinch roller 21 provides a conveying force to the first eject roller 4, and is rotated by the first eject roller 4. The first pinch roller (spur roller) 21 and the second pinch roller (spur roller) 22 are held by a pinch roller (spur roller) holder 23.

After printing has been performed on the recording sheet in the printing section and if print data for the back side of the recording sheet is not present, the recording sheet is ejected by the second eject roller 5 and the first eject roller 4 to a sheet ejecting section, and the print operation is finished. The second eject roller 5 and the first eject roller 4 correspond to an ejection unit.

Figure 4:
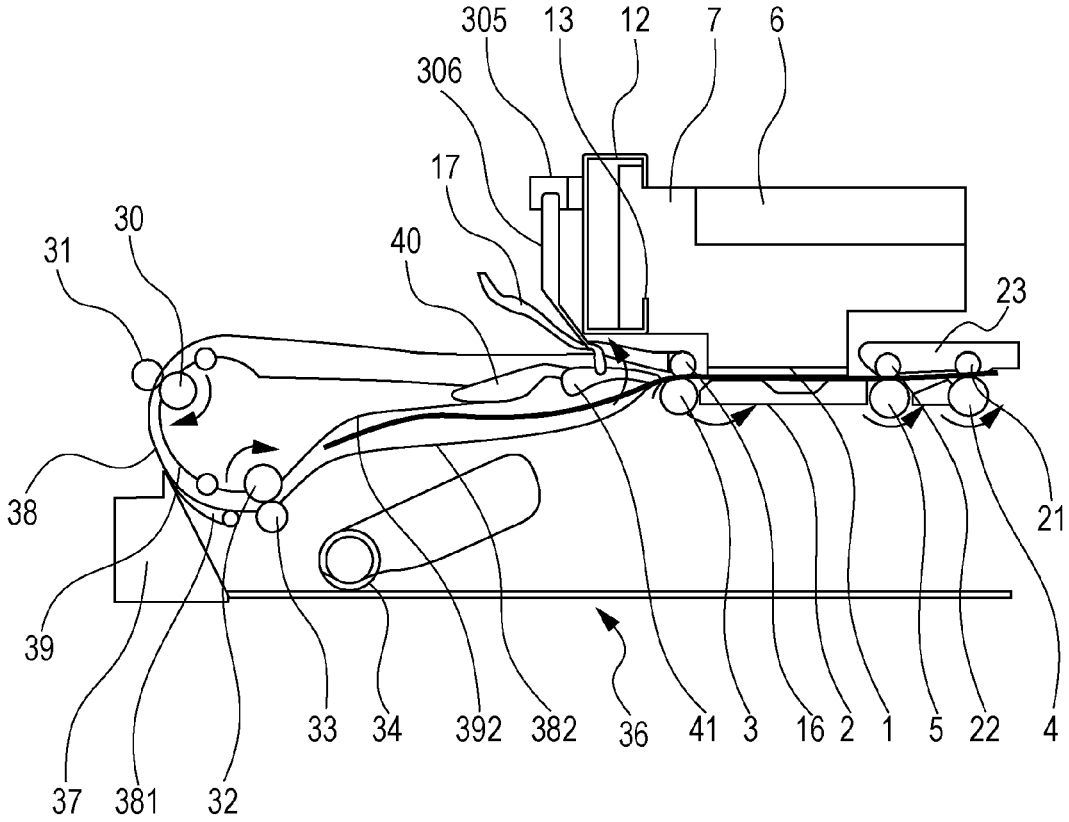
FIG. 4 is a sectional view of a recording sheet reversal mechanism.

Referring to FIG. 4, how the recording sheet is conveyed during duplex printing will be described. When printing on a first surface (front surface) of the recording sheet has been finished in the printing section, the conveying roller 3, the first eject roller 4, and the second eject roller 5 are rotated reversely, and the recording sheet is conveyed in a reverse direction that is opposite to the predetermined conveying direction. The sheet guide flapper 41 is rotated upward in time with the reverse rotation, and the recording sheet, which is conveyed in the opposite direction, is guided to a space below the sheet guide flapper 41. The recording sheet, which is being conveyed, is guided to a reverse sheet conveying path between an outer duplex guide 382 and an inner duplex guide 392. The recording sheet, which has been guided to the reverse sheet conveying path, is nipped between a duplex conveying roller 32 and a pinch roller 33, and conveyed to a feeding/conveying roller 30 and a pinch roller 31. Subsequently, the recording sheet is guided by the sheet guide 40, the sheet guide flapper 41, and a sheet guiding portion of the pinch roller holder 17, and conveyed to the conveying roller 3.

Next, the recording sheet is conveyed to the printing section, and printing is performed on a second surface (back surface). Thus, duplex printing is performed. The reverse sheet conveying path for duplex printing will be referred to as a conveying path. The reverse sheet conveying path, which has an annular shape, extends from an entrance below the sheet guide flapper 41 to an exit at the downstream end of the sheet guide 40. The recording sheet is reversed while the recording sheet is conveyed through the reverse sheet conveying path. The duplex conveying roller 32, the pinch roller 33, the feeding/conveying roller 30, and the pinch roller 31, which convey the recording sheet in the reverse sheet conveying path, constitute a second conveying unit.

After printing has been performed on the recording sheet in the printing section, the recording sheet is ejected to the sheet ejecting section by the second eject roller 5 and the first eject roller 4, and the print operation is finished.

Next, a front sheet feeder will be described. Recording sheets that are stacked on a front sheet cassette 36 are conveyed from the front side toward the back side of the main body of the apparatus by a front sheet feed roller 34. The front sheet feed roller 34 applies a conveying force to the recording sheets, and the uppermost recording sheet is separated by a front feeding separation guide 37 and fed out. The recording sheet, which has been fed out by the front sheet feed roller 34, pushes up a duplex flapper 381, which is rotatable, with its own weight. The recording sheet is guided to the sheet guiding portions of an outer U-turn guide 38 and an inner U-turn guide 39. The recording sheet is nipped between the feeding/conveying roller 30 and the pinch roller 31 and conveyed further, guided to the sheet guide 40 of the conveying roller, the sheet guide flapper 41, and the sheet guiding portion of the pinch roller holder 17, and conveyed to the conveying roller 3. This recording sheet conveying path for front sheet feeding will be referred to as a second conveying path. The conveying path and the second conveying path both include the conveying path after the duplex flapper 381.

The sheet feeder of the present embodiment includes the sheet feeder unit 51 and the front sheet feeder. However, the sheet feeder may have only the front sheet feeder.

Next, a recording sheet detection sensor 305 will be described. The recording sheet detection sensor 305 is disposed at a position that is near to the nip between the conveying roller 3 and the pinch roller 16 and that is upstream of the nip in the recording sheet conveying direction. The recording sheet detection sensor 305 detects the presence or absence of a recording sheet directly, or indirectly by using a lever or the like. In the present embodiment, a photointerruptor is used as the recording sheet detection sensor 305. However, the type of the sensor is not limited thereto. In the present embodiment, a recording sheet is detected when a leading end of the recording sheet rotates a recording sheet detection lever 306, which is urged by a spring, and opens the optical path of the photointerruptor of the recording sheet detection sensor 305, which is normally blocked.

Figure 3:
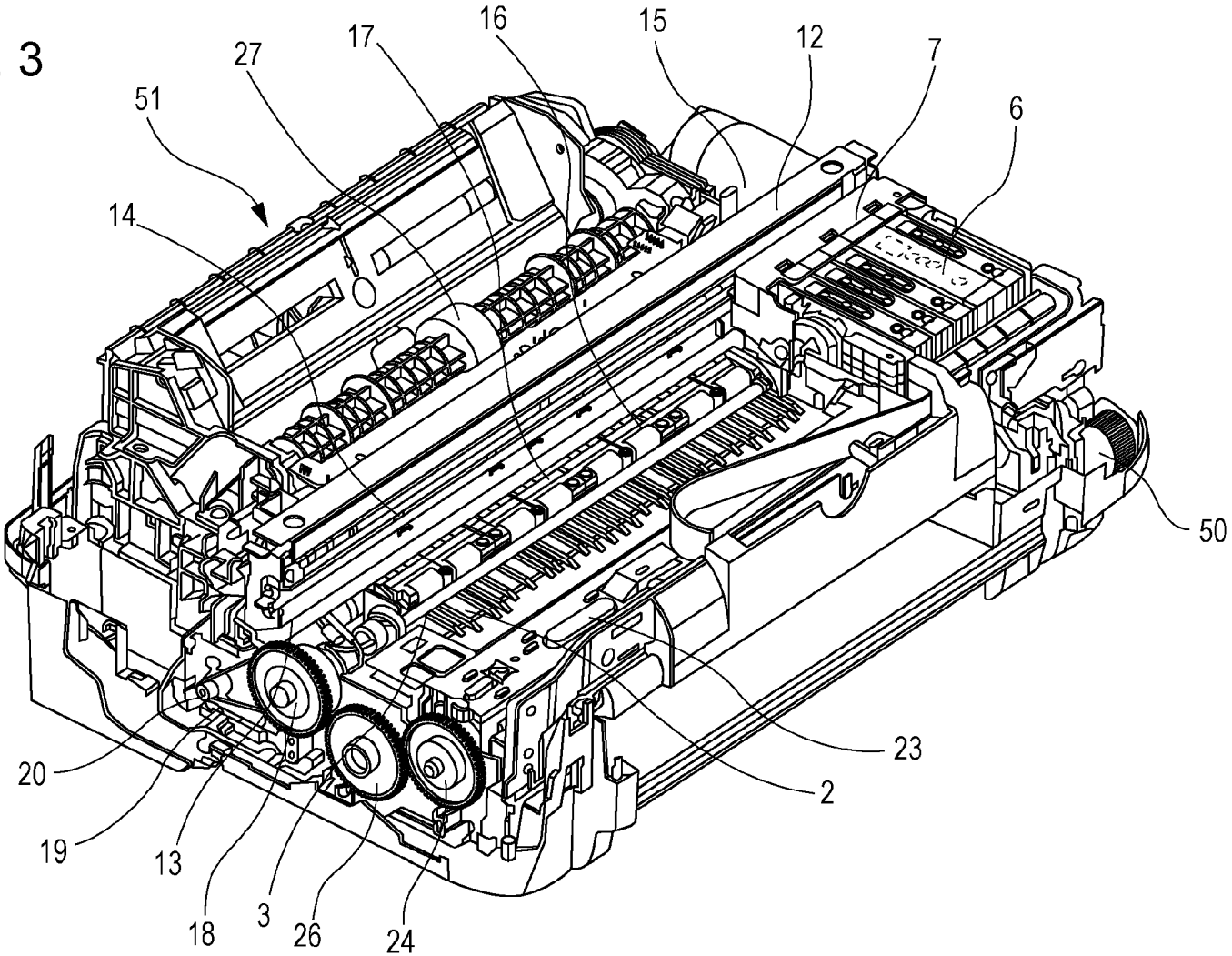
FIG. 3 is a perspective view of the body of the embodiment.
Figure 5:
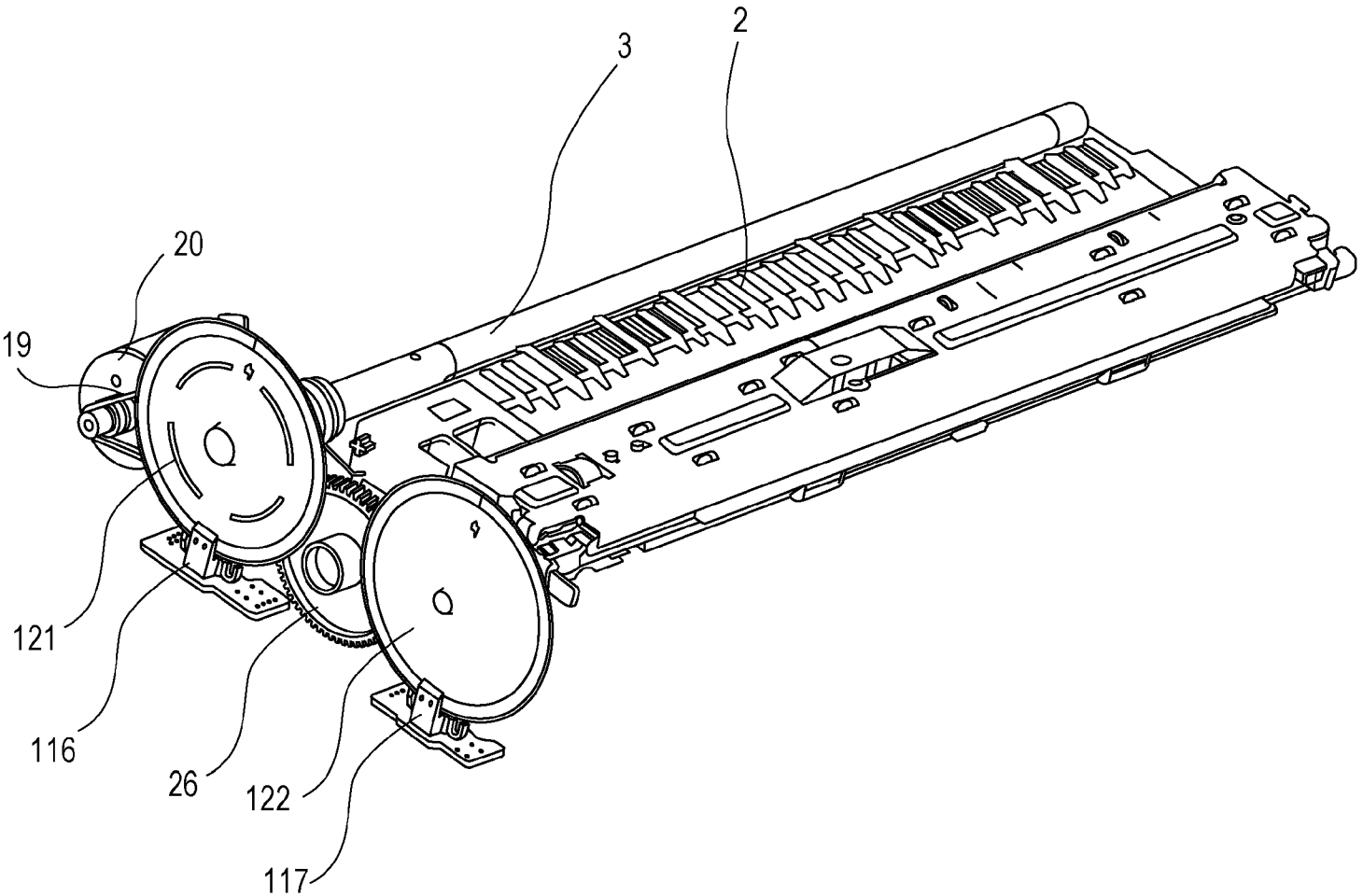
FIG. 5 is a left perspective view illustrating the driving structure of a conveying roller and an eject roller.
Figure 6:
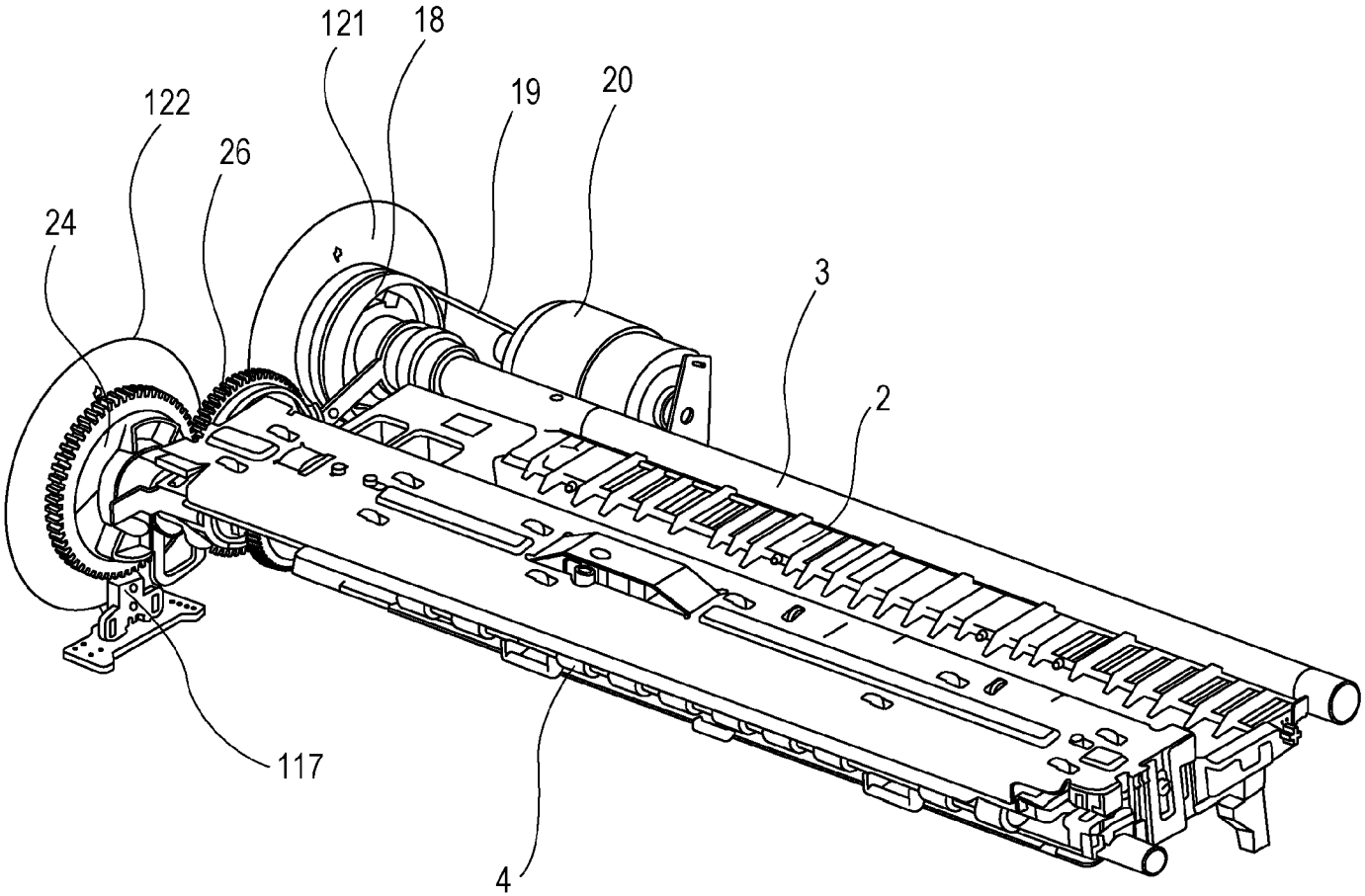
FIG. 6 is a right perspective view illustrating the driving structure of the conveying roller and the eject roller.

Next, referring to FIGS. 3, 5, and 6, the driving structure of the conveying roller 3, the first eject roller 4, and the second eject roller 5 will be described. Rotation is transferred from a conveying roller motor 20 through a conveying timing belt 19 to a conveying roller gear 18 that is fixed to the conveying roller 3. Next, the rotation is transferred from the conveying roller gear 18 through a sheet ejection drive gear 26 to a first eject roller gear 24 that is fixed to the first eject roller 4. The rotation is transferred through an ejection idler gear (not shown) disposed on the platen 2 to the second eject roller 5 disposed on the platen 2. A conveying roller code wheel 121 and an eject roller code wheel 122 are attached to the conveying roller 3 and the first eject roller 4, respectively, so as to detect the rotation angle of the rollers. A conveying roller encoder sensor 116 and an eject roller encoder sensor 117 are provided to the code wheels 121 and 122, respectively, so as to read markings on the code wheels 121 and 122.

Figure 7:
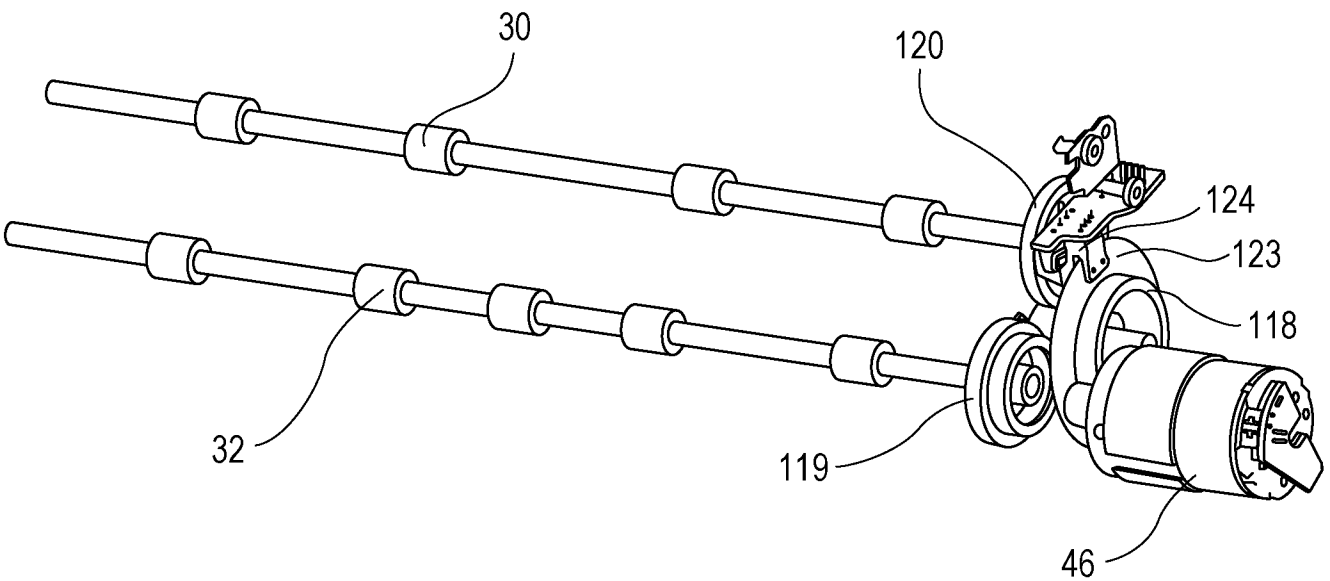
FIG. 7 is a perspective view illustrating the driving structure of a duplex conveying roller and a feeding/conveying roller.

Next, referring to FIG. 7, the driving structure of the duplex conveying roller 32 and the feeding/conveying roller 30 will be described. Rotation is transferred from a feeding/recovery/conveying motor 46 through a duplex conveying gear 118 to a duplex conveying roller gear 119, which is fixed to the duplex conveying roller 32, and a feeding/conveying roller gear 120, which is fixed to the feeding/conveying roller 30. A duplex conveying roller code wheel 123 is attached to the rotation axis of the duplex conveying gear 118, which corresponds to a rotating member, so as to detect the conveyance amount of the duplex conveying roller 32 and the feeding/conveying roller 30. A duplex conveying roller encoder sensor 124 is disposed on the body so as to read markings on the duplex conveying roller code wheel 123. The duplex conveying roller code wheel 123 and the duplex conveying roller encoder sensor 124 constitute a rotation direction detecting unit. In the present embodiment, the feeding/conveying roller 30 and the duplex conveying roller 32 are driven by the same drive source. However, these rollers may be driven by different drive sources. A single duplex conveying roller or a plurality of duplex conveying rollers may be disposed on the reverse sheet conveying path. In the case where a plurality of duplex conveying rollers are disposed, the duplex conveying rollers may be driven by a common drive source or driven by different drive sources.

Next, a recovery unit 50 and a drive switching unit 45 will be described. The recovery unit 50 recovers and stabilizes ejection performance of a recording head. The drive switching unit 45 switches whether to transfer the rotation to the feed unit, to the conveying unit, or to the recovery unit. The recovery unit 50 is disposed in a front right portion of the body, and faces the stand-by position of the recording head 1.

The drive switching unit 45 is disposed in a back right portion of the body. The feed unit, the conveying unit, and the recovery unit are driven by the feeding/recovery/conveying motor 46. Which of these units to be driven by the feeding/recovery/conveying motor 46 can be changed by switching the transfer path of rotation by using a switching unit (not shown).

Next, referring to FIG. 8, the structures of a controller 1750 and a main power unit 1900 will be described. The controller 1750, which corresponds to a control unit, is a main part of a control system of the recording mechanism of the recording apparatus.

Figure 8:
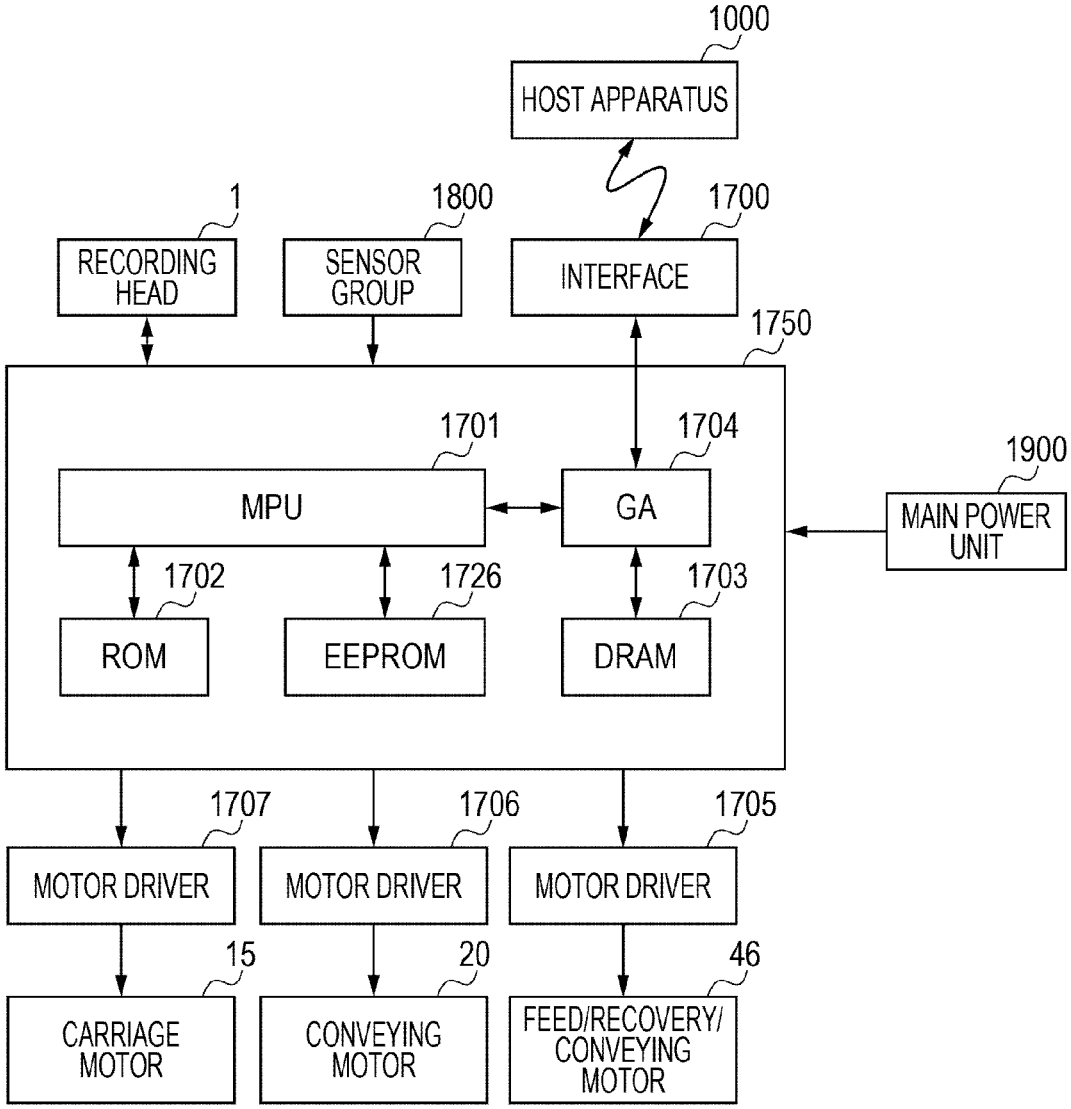
FIG. 8 is a block diagram of a main part of a control system.

In FIG. 8, an interface 1700 receives a command and a recording signal including image data, which are sent from a host apparatus 1000. The host apparatus 1000 is a computer, a digital camera, a scanner, or the like. Moreover, the interface 1700 sends status information of the recording apparatus to the host apparatus 1000 as necessary.

The controller 1750 includes an MPU 1701, a ROM 1702, a DRAM 1703, a gate array (GA) 1704, and a non-volatile memory 1726. The MPU 1701 controls various sections of the printer in accordance with a control program and necessary data. The control program, which is stored in the ROM 1702, corresponds to the process illustrated in FIG. 13. The DRAM 1703 stores various data. The gate array 1704 controls the supply of recording data to the recording head 1, and also controls transfer of data among the interface 1700, the MPU 1701, and the DRAM 1703. The non-volatile memory 1726, which is an EEPROM or the like, stores necessary data even when the recording apparatus is powered off.

Motor drivers 1705, 1706, and 1707 respectively drive the feeding/recovery/conveying motor 46, the conveying roller motor 20, and the carriage motor 15.

Moreover, the controller 1750 sends the recording data to the recording head 1. A sensor group 1800 is connected to the controller 1750.

The main power unit 1900 is connected to the controller 1750.

Figure 10:
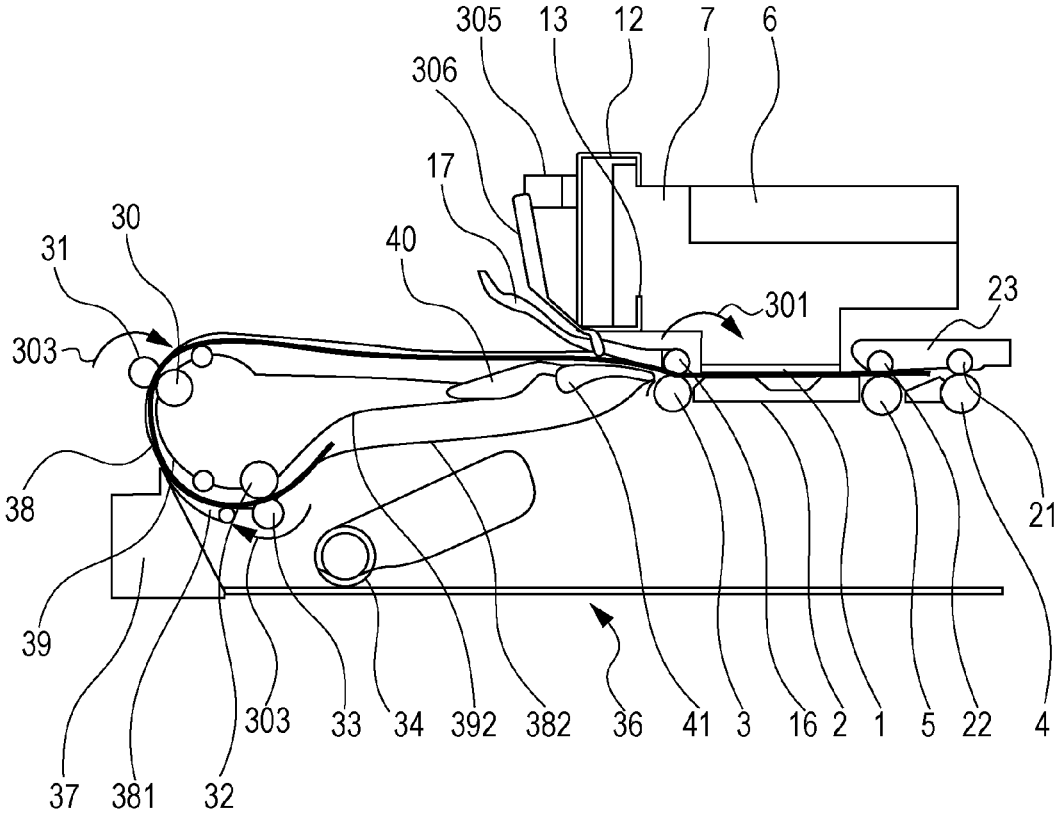
FIG. 10 illustrates an operation of the recording apparatus.
Figure 11:
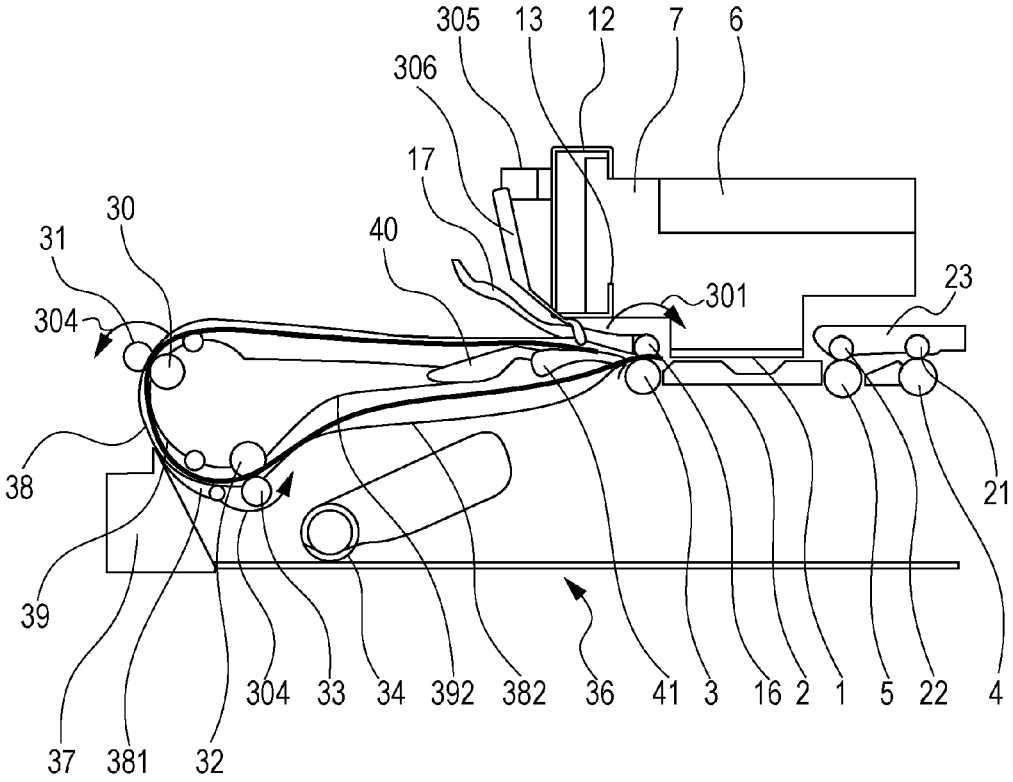
FIG. 11 illustrates an operation of the recording apparatus.
Figure 12:
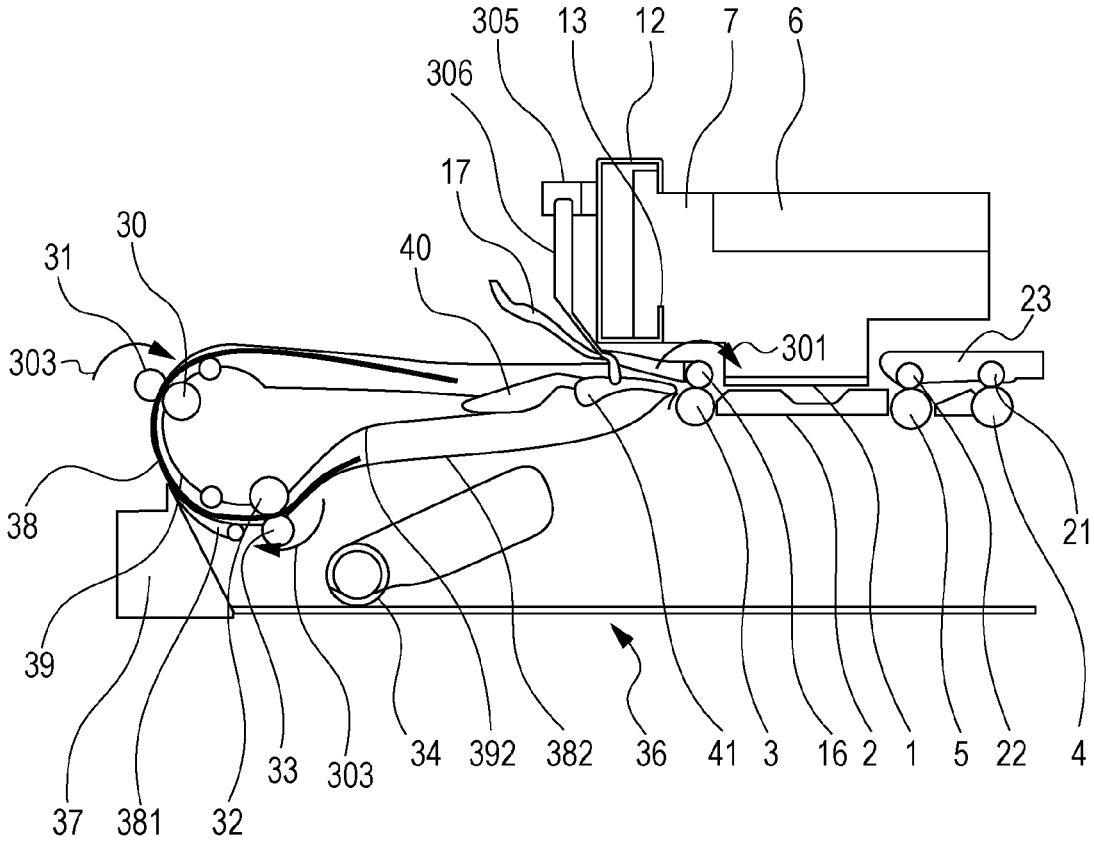
FIG. 12 illustrates an operation of the recording apparatus.
Figure 13:
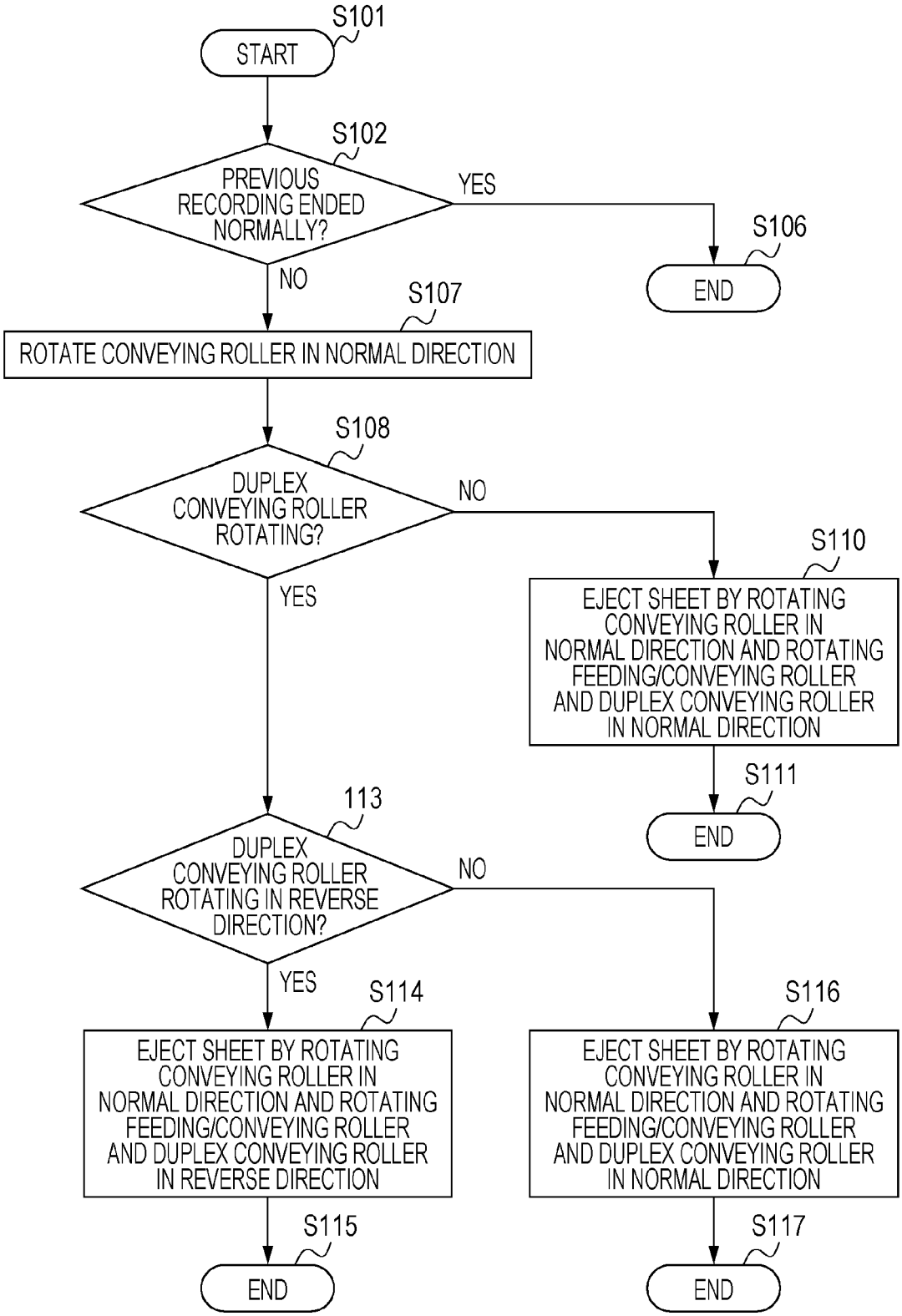
FIG. 13 is a flowchart illustrating a control process according to the embodiment.

Next, an initialization process, which characterizes the present invention, will be described. The initialization process is performed when the recording apparatus according to the present embodiment is powered on when a recording sheet has been left in the conveying path. FIG. 13 is a flowchart illustrating the initialization process. FIGS. 10 to 12 schematically illustrate the states in which a recording sheet is left in the conveying path.

Figure 9:
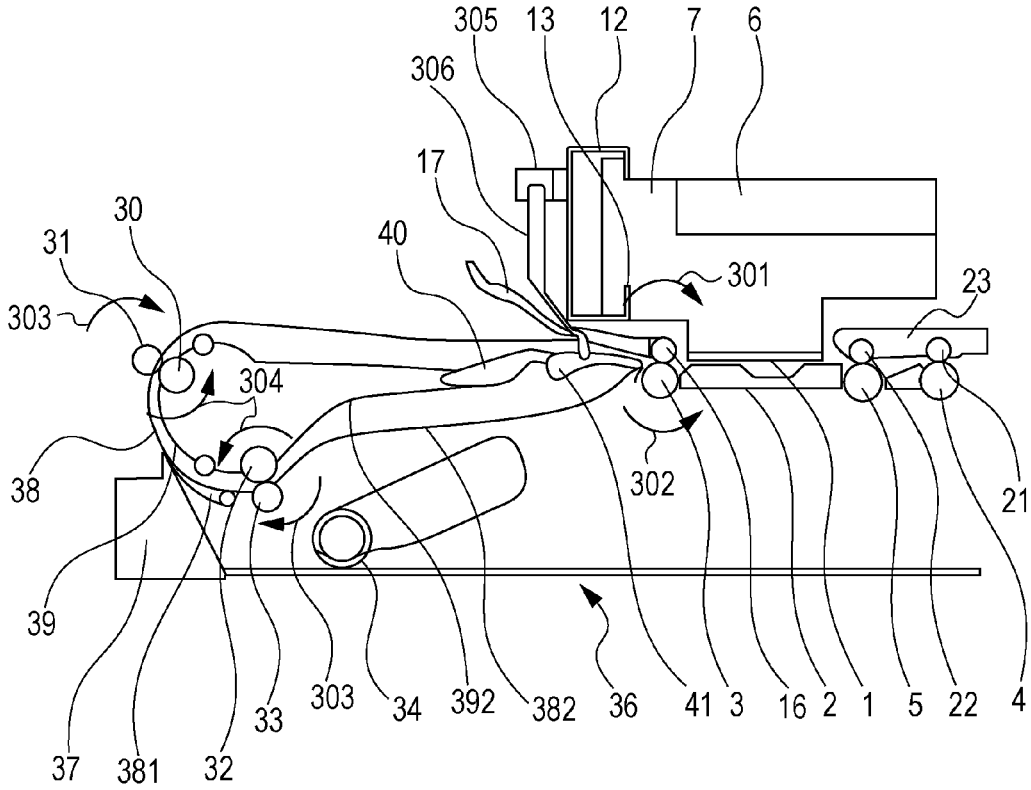
FIG. 9 illustrates an operation of a recording apparatus.

FIG. 9 schematically illustrates the dispositions of the conveying roller 3, the feeding/conveying roller 30, and the duplex conveying roller 32. In FIG. 9, an arrow 301 indicates an eject conveying direction (normal rotation) of the conveying roller 3, an arrow 302 indicates a pulling conveying direction (reverse rotation) of the conveying roller 3, an arrow 303 indicates a normal conveying direction (normal rotation) of the feeding/conveying roller 30 and the duplex conveying roller 32, and an arrow 304 indicates a reverse conveying direction (reverse rotation) of the feeding/conveying roller 30 and the duplex conveying roller 32.

Examples of the position of the recording sheet in the conveying path are as follows.

As illustrated in FIG. 10, the recording sheet used in the recording apparatus according to the present embodiment has a length that is larger than that of the conveying route that extends from the entrance at the conveying roller 3 through the conveying path to the duplex conveying roller 32. In FIG. 10, the recording sheet is nipped between the conveying roller 3 and the pinch roller 16, between the feeding/conveying roller 30 and the pinch roller 31, and between the duplex conveying roller 32 and the pinch roller 33 in the conveying path. Moreover, the recording sheet is detected by the recording sheet detection sensor 305. In this case, in order to eject the recording sheet, the conveying roller 3 is rotated in the direction of the arrow 301, and the feeding/conveying roller 30 and the duplex conveying roller 32 are rotated in the direction of the arrow 303.

As illustrated in FIG. 11, the recording sheet has a length that is larger than that of the conveying route that extends from the feeding/conveying roller 30 through the conveying path and the exit to the conveying roller 3. Also in FIG. 11, the recording sheet is nipped between the conveying roller 3 and the pinch roller 16, between the feeding/conveying roller 30 and the pinch roller 31, and between the duplex conveying roller 32 and the pinch roller 33 in the conveying path. Moreover, the recording sheet is detected by the recording sheet detection sensor 305. However, the case illustrated in FIG. 11 is different from that of FIG. 10: in this case, in order to eject the recording sheet, it is necessary to rotate the conveying roller 3 in the direction of the arrow 301 and rotate the feeding/conveying roller 30 and the duplex conveying roller 32 in the direction of the arrow 304.

In such a case where it is not possible to determine how to eject the recording sheet that has been left in the conveying path by using only the recording sheet detection sensor 305, the recording sheet can be appropriately ejected by performing the process according to the present invention, which is illustrated in FIG. 13.

The process illustrated in the flowchart of FIG. 13 will be described below. The process starts when the recording apparatus is powered on or when a reset button is pressed (step S101). In step S102, whether the previous operation ended normally is determined. If it is determined that the previous operation ended normally, the process ends (step S106).

If it is determined that the previous operation did not end normally, the process proceeds to step S107 and the conveying roller 3 is rotated in the normal direction (direction of the arrow 301). In step S108, whether the duplex conveying roller 32 is being rotated due to the normal rotation of the conveying roller 3 is detected. If the rotation of the duplex conveying roller 32 is detected, in which direction the duplex conveying roller 32 is rotating is determined in step S113. When the duplex conveying roller encoder sensor 124 detects that the feeding/conveying roller 30 and the duplex conveying roller 32 is rotating in the normal direction (direction of the arrow 303), the recording apparatus is in the state illustrated in FIG. 10. That is, the recording sheet is nipped between the feeding/conveying roller 30 and the pinch roller 31, and a part of the recording sheet that is downstream of the feeding/conveying roller 30 is nipped between the conveying roller 3 and the pinch roller 16. In this case, the process proceeds to step S116, and control is performed to rotate the conveying roller motor 20 and the feeding/recovery/conveying motor 46 in the normal direction, whereby the conveying roller 3 is rotated in the normal direction (direction of the arrow 301) and the feeding/conveying roller 30 and the duplex conveying roller 32 are rotated in the normal direction (direction of the arrow 303). The recording sheet is conveyed by the conveying roller 3 to the second eject roller 5 and the first eject roller 4, which are being rotated, and ejected from the recording apparatus. Thus, the process of ejecting the recording sheet during initialization of the recording apparatus is finished (step S117).

Depending on the length and the stopping position of the recording sheet, the same control is performed when the recording sheet is nipped only between the conveying roller 3 and the pinch roller 16 and between the feeding/conveying roller 30 and the pinch roller 31.

The rotation speed of the conveying roller 3 in step S107 is a speed that causes the feeding/conveying roller 30 and the duplex conveying roller 32 to rotate due to the movement of the recording sheet.

In step S113, when the duplex conveying roller encoder sensor 124 detects that the feeding/conveying roller 30 and the duplex conveying roller 32 rotates in the reverse direction (direction of the arrow 304), the recording apparatus is in the state illustrated in FIG. 11. That is, the recording sheet is nipped between the duplex conveying roller 32 and the pinch roller 33, and a part of the recording sheet that is upstream of the duplex conveying roller 32 is nipped between the conveying roller 3 and the pinch roller 16. In this case, the process proceeds to step S114, and the conveying roller motor 20 is rotated in the normal direction and the feeding/recovery/conveying motor 46 is rotated in the reverse direction, so that the conveying roller 3 is rotated in the normal direction and the feeding/conveying roller 30 and the duplex conveying roller 32 are rotated in the reverse direction. The recording sheet is conveyed from the conveying roller 3 to the second eject roller 5 and the first eject roller 4, which are being rotated, and ejected from the recording apparatus. Thus, the process of ejecting the recording sheet during initialization of the recording apparatus is finished (step S115). Depending on the length and the stopping position of the recording sheet, the same control is performed when the recording sheet is nipped only between the conveying roller 3 and the pinch roller 16 or only between the duplex conveying roller 32 and the pinch roller 33. The same control is performed irrespective of whether the recording sheet detection sensor 305 detects the presence of the recording sheet.

If it is determined in step S108 that the feeding/conveying roller 30 and the duplex conveying roller 32 are not rotated when the conveying roller 3 is rotated by a predetermined amount in the normal direction (direction of the arrow 301) in step S107, the process proceeds to step S110. In this case, as illustrated in FIG. 12, the recording sheet is not nipped between the conveying roller 3 and the pinch roller 16. Instead, the recording sheet is nipped between the duplex conveying roller 32 and the pinch roller 33 and between the feeding/conveying roller 30 and the pinch roller 31.

In step S110, control is performed to rotate the conveying roller motor 20 and the feeding/recovery/conveying motor 46 in the normal rotation so that the conveying roller 3 is rotated in the normal direction (direction of the arrow 301) and the feeding/conveying roller 30 and the duplex conveying roller 32 are rotated in the normal direction (direction of the arrow 303). The recording sheet is conveyed from the conveying roller 3 to the second eject roller 5 and the first eject roller 4, which are being rotated, and ejected from the recording apparatus. Thus, the process of ejecting the recording sheet during initialization of the recording apparatus is finished (step S111).

Depending on the length and the stopping position of the recording sheet, the same control is performed when the recording sheet is nipped only between the conveying roller 3 and the pinch roller 16, only between the feeding/conveying roller 30 and the pinch roller 31, or only between the duplex conveying roller 32 and the pinch roller 33. The same control is performed irrespective of whether the recording sheet detection sensor 305 detects the presence of the recording sheet.

The rotation speed of the conveying roller 3 in step S107 is a speed that causes the feeding/conveying roller 30 and the duplex conveying roller 32 to rotate due to the movement of the recording sheet.

The process illustrated in the flowchart of FIG. 13 can be used when the recording sheet detection sensor 305 is not provided in the present embodiment.

According to the present embodiment, if information stored in the non-volatile EEPROM 1726 indicates that the previous printing ended normally, the initialization process does not perform the step of sheet ejection (S102 and S106).

The duplex conveying roller code wheel 123 has a plurality of patterns of markings, so that the direction of rotation of the duplex conveying roller 32 can be determined from the order in which the duplex conveying roller encoder sensor 124 detects the patterns.

The present embodiment can provide a low-cost recording apparatus by reducing the number of recording sheet detection sensors. The frequency of manual operations by a user to remove jammed sheets can be minimized.

Moreover, the direction in which the recording sheet is ejected with the shortest conveying distance can be automatically selected, whereby damage to the recording sheet and the conveying roller can be minimized.

The direction in which the recording sheet is ejected with the shortest conveying distance can be automatically selected without using a large number of sensors for detecting the position of the recording sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-269193 filed Nov. 26, 2009, which is hereby incorporated by reference herein in its entirety.

What is claimed is:

1. A sheet conveying device comprising:

a first conveying unit configured to convey a sheet in a conveying direction;

a conveying path bounded by an inner guide and an outer guide, configured to guide the sheet;

a reversing portion of the conveying path forms a loop so as guide the sheet in a direction opposite to the conveying direction along one portion of the reversing portion of the conveying path, and to guide the sheet in the conveying direction along a second portion of the reversing portion of the conveying path;

a second conveying unit configured to convey the sheet along the reversing portion of the conveying path;

a rotation direction detecting unit configured to detect a rotation direction of the second conveying unit; and a control unit configured to perform control, at startup, to drive the first conveying unit in a direction that causes the sheet to be conveyed in the conveying direction without driving the second conveying unit such that the second conveying unit is rotated by the sheet being conveyed by the first conveying unit during a first step, and to drive the second conveying unit in the rotation direction that is detected by the rotation direction detecting unit during a second step after the first step.

2. The sheet conveying device according to claim 1, wherein the control unit is configured to perform control, at startup, to drive the first conveying unit in the direction that causes the sheet to be conveyed in the conveying direction during the first step, and if the rotation direction detection unit does not detect rotation of the second conveying unit, to drive the second conveying unit in a predetermined rotation direction during the second step.

3. The sheet conveying device according to claim 1,
wherein the conveying path includes an entrance for receiving the sheet conveyed by the first conveying unit in the direction opposite to the conveying direction and an exit for guiding the sheet to the first conveying unit.

4. The sheet conveying device according to claim 3,
wherein the control unit is configured to perform control, at startup, to drive the second conveying unit during the second step in a direction that causes the sheet to be conveyed toward the exit, if the rotation direction detection unit does not detect rotation of the second conveying unit when the first conveying unit is rotated in the direction that causes the sheet to be conveyed in the conveying direction during the first step.

5. The sheet conveying device according to claim 1,
wherein the control unit is configured to perform control at startup, if previous control did not end normally, to drive the first conveying unit in the direction that causes the sheet to be conveyed in the conveying direction during the first step, and when the rotation direction detecting unit detects rotation of the second conveying unit, to drive the second conveying unit in the direction detected by the rotation direction detecting unit during the second step, and the control unit is configured not to perform the control if the previous control ended normally.

6. The sheet conveying device according to claim 1,
wherein, if the sheet conveying device is powered on when the first conveying unit and the second conveying unit are nipping the same sheet, the second conveying unit that is not driven is rotated by the sheet that is conveyed by the first conveying unit when the control unit performs control to drive the first conveying unit in a direction that causes the sheet to be conveyed in the conveying direction during the first step.

7. The sheet conveying device according to claim 3,
wherein a length of a conveying route from the first conveying unit through the entrance and the conveying path to the second conveying unit is smaller than a length of the sheet that is conveyed.

8. The sheet conveying device according to claim 3,
wherein a length of a conveying route from the second conveying unit through the conveying path and the exit to the first conveying unit is smaller than a length of the sheet that is conveyed.

9. The sheet conveying device according to claim 1,
wherein the second conveying unit includes a plurality of conveying rollers that are disposed along the conveying path and that are driven by a common drive source.

10. The sheet conveying device according to claim 1, further comprising:
an ejection unit configured to eject the sheet from the sheet conveying device, the ejection unit being disposed downstream of the first conveying unit in the conveying direction.

11. The sheet conveying device according to claim 1,
wherein the rotation direction detecting unit includes a code wheel and an encoder sensor that are attached to a rotating member that transfers rotation of a drive source to the second conveying unit.

12. A recording apparatus comprising:
the sheet conveying device according to claim 1; and
a recording unit configured to perform recording on the sheet that is conveyed by the first conveying unit,
wherein, after recording has been performed on a first surface of the sheet and the sheet has been transferred in the direction opposite to the conveying direction by the first and the second conveying units,
the sheet is reversed while the sheet is conveyed by the second conveying unit in the conveying path and conveyed again to the first conveying unit, and
recording is performed on a second surface of the sheet by the recording unit.

13. A recording apparatus comprising:
a recording head configured to perform recording operation on a recording medium;
a first conveying unit disposed upstream of the recording head in a first direction in which the recording medium is conveyed when the recording head performs the recording operation thereon;
a first driving source configured to drive the first conveying unit, wherein the first conveying unit conveys the recording medium in the first direction in a case where the first driving source rotates in a normal direction, and conveys the recording medium in a second direction opposite to the first direction in a case where the first driving source rotates in a reverse direction;
a reversing unit configured to reverse sides of the recording medium conveyed in the second direction by the first conveying unit and convey the reversed recording medium to the first conveying unit;
a second conveying unit disposed in the reversing unit and configured to convey the recording medium;
a detecting unit configured to detect a rotation direction of the second conveying unit;
a second driving source configured to drive the second conveying unit, the second driving source being able to rotate in the normal direction and in the reverse direction and rotating in the normal direction in a case where the recording medium is reversed by the reversing unit; and
a control unit configured to cause the detecting unit to detect a rotation direction of the second conveying unit when the second driving source is not driven and the first driving source is driven in the normal direction, and cause the second driving source to drive in the rotation direction detected by the detecting unit.

14. The recording apparatus according to claim 13, wherein a conveying force of the first conveying unit is larger than a conveying force of the second conveying unit.

15. The recording apparatus according to claim 13, wherein the second conveying unit includes a plurality of pairs of conveying rollers.

16. The recording apparatus according to claim 13, wherein, in a case where the detecting unit detects that the second conveying unit does not rotate when the second driving source is not driven and the first driving source is driven in the normal direction, the control unit causes the second driving source to rotate in the normal direction.

17. The recording apparatus according to claim 13, further comprising a determination unit configured to determine whether a previous power-off operation has been normally performed.

* * * * *